US005671065A

United States Patent [19]

Lee

[11] Patent Number: 5,671,065

[45] Date of Patent: Sep. 23, 1997

[54] PAPER CONVEYING AND AUTOMATIC CUTTING DEVICE FOR A FACSIMILE APPARATUS WHICH USES A SINGLE BI-DIRECTIONAL DRIVE MOTOR

[75] Inventor: Hyun-Jun Lee, Busanjikhal, Rep. of Korea

[73] Assignee: SamSung Electronics Co., Ltd., Suwon, Rep. of Korea

[21] Appl. No.: 275,673

[22] Filed: Jul. 15, 1994

[30] Foreign Application Priority Data

Dec. 1, 1993 [KR] Rep. of Korea ..... 26118/1993

[51] Int. Cl.[6] ..... B41J 11/70

[52] U.S. Cl. ..... 358/304; 101/93.07; 346/24; 400/185

[58] Field of Search ..... 358/304; 346/24; 400/621, 593, 185; 101/93.07

[56] References Cited

U.S. PATENT DOCUMENTS

| | | | |
|---|---|---|---|
| 326,183 | 1/1885 | Werts . | |
| 347,350 | 8/1886 | Hildreth . | |
| 1,788,153 | 1/1931 | Everett . | |
| 2,832,410 | 4/1958 | Soss . | |
| 3,585,289 | 6/1971 | Huber | 358/304 |
| 3,831,399 | 8/1974 | Majkrzak et al. | 464/181 |
| 4,122,497 | 10/1978 | Suzuki et al. | 358/304 |
| 4,124,435 | 11/1978 | Stump et al. | 156/521 |
| 4,228,709 | 10/1980 | Guzar, Jr. et al. | 83/620 |
| 4,234,244 | 11/1980 | Klein | 359/806 |
| 4,240,730 | 12/1980 | Dodge | 354/90 |
| 4,299,380 | 11/1981 | Ogihara et al. | 271/9.09 |
| 4,317,139 | 2/1982 | Nelson | 358/300 |
| 4,421,587 | 12/1983 | Guenther et al. | 156/256 |
| 4,510,841 | 4/1985 | Farran et al. . | |
| 4,544,293 | 10/1985 | Cranston et al. | 400/320 |
| 4,646,162 | 2/1987 | Sue . | |
| 4,802,437 | 2/1989 | Felicetti | 116/62.4 |
| 4,926,358 | 5/1990 | Tani et al. | 364/562 |
| 5,088,370 | 2/1992 | Kondo | 83/528 |
| 5,105,703 | 4/1992 | Kondo | 83/636 |
| 5,223,940 | 6/1993 | Matsumoto | 358/304 |
| 5,279,472 | 1/1994 | Hongo et al. | 242/422.2 |
| 5,413,426 | 5/1995 | Ijuin et al. | 400/621 |
| 5,482,389 | 1/1996 | Bickoff et al. | 400/621 |
| 5,505,552 | 4/1996 | Hasegawa et al. | 400/621 |

FOREIGN PATENT DOCUMENTS

| | | | |
|---|---|---|---|
| 4-265770 | 9/1992 | Japan | 400/593 |

*Primary Examiner*—Peter S. Wong
*Assistant Examiner*—Derek J. Jardieu
*Attorney, Agent, or Firm*—Robert E. Bushnell, Esq.

[57] ABSTRACT

A device for conveying and automatically cutting paper in a facsimile apparatus. When a motor rotates forwardly, a roller for conveying paper rotates, and when the motor rotates reversely, the paper is cut. A stationary cutting edge of an automatic cutter is horizontally fixed and a movable cutting edge installed at the upper portion of the stationary cutting edge moves up and down. Then the paper is cut and a paper jam is prevented by automatic cutter.

23 Claims, 5 Drawing Sheets

PAPER CONVEYING AND AUTOMATIC CUTTING DEVICE FOR A FACSIMILE APPARATUS WHICH USES A SINGLE BI-DIRECTIONAL DRIVE MOTOR

CROSS-REFERENCE TO RELATED APPLICATIONS

This application makes reference to, incorporates the same herein, and claims all benefits incurring under 35 U.S.C. §119 from an application for "Paper Conveying and Automatic Cutting Device for a Facsimile Appratus" filed in the Korea Industrial Properly Office on 1 Dec., 1993 and assigned Serial No. 1993/26118.

BACKGROUND OF THE INVENTION

The present invention relates to a facsimile apparatus, and more particularly, to a device for conveying and automatically cutting paper in a facsimile apparatus.

A facsimile apparatus stores data transmitted from exterior sources in a memory, records the transmitted data on thermal paper with a thermal recording head, cuts the thermal paper and ejects the paper to the exterior, thereby reproducing a visual image. Since such a facsimile apparatus mainly uses rolls of thermal paper, the paper needs to be cut to a suitable length after a document has been produced.

During the operation of the facsimile apparatus, a sheet of paper from a roll of paper passes over a roller to a thermal recording head installed over the roller. The contents of a document transmitted from an external source and received by the facsimile apparatus is recorded on the paper by the thermal recording head. The paper is then conveyed by the roller to a guide. The guide directs the paper to an automatic cutter consisting of a stationary cutting edge and a movable cutting edge. While the paper passes between the stationary cutting edge and the movable cutting edge, the paper is uniformly cut and sequentially stacked in a tray.

The motor continues to rotate clockwise after cutting the thermal paper and the shaft fixed at one side of the rotating gear engaged with the spindle gear shifts the plate downward within the mortise by sliding within mortise. Then the side at which the fixed pin is installed moves upward and the movable cutting edge moves upward from the stationary cutting edge, thereby conveying the thermal paper.

Conventional facsimile devices for conveying and cutting the thermal paper use two motors. One is for turning the roller conveying the thermal paper, and the other is for turning the movable cutting edge. This results in increased manufacturing cost. Additionally, conventional automatic cutting devices used in conventional facsimile devices have a stationary cutting edge positioned vertically in relation to the paper while the paper is conveyed through the facsimile device. Consequently, the paper may catch the stationary cutting edge and cause a paper jam during the cutting process.

Sue (U.S. Pat. No. 4,646,162) and Matsumoto (U.S. Pat. No. 5,223,940) are additional examples of conventional facsimile and image recording devices.

In Sue (U.S. Pat. No. 4,646,162), a driving device for a facsimile apparatus is shown with a pair of reversible motors and an automatic cutting device. The two reversible motors separately function to advance a document through the facsimile device, cut the document and reverse the direction of the document to allow the moveable cutting edge of the automatic cutting device to return to its original position.

The conventional paper conveying and automatic cutting device requires two motors. To turn the roller installed under the thermal recording head, a gear is fixedly mounted at one side of the roller and an idle gear is installed to engage the gear while a driving gear of a driving motor engages the idle gear. If the driving gear of the driving motor rotates clockwise, the idle gear rotates counterclockwise and the gear rotates clockwise. Accordingly, the roller rotates clockwise and the thermal paper on which the contents of a document are recorded by the thermal recording head is conveyed towards the automatic cutter.

A conventional automatic cutter driving device for cutting the thermal paper while the thermal paper passes between the stationary cutting edge and the movable cutting edge is driven by a separate motor. A pair of holes are respectively formed at left and right plates of the stationary cutting edge to assemble the movable cutting edge at the upper portion of the vertically fixed stationary cutting edge. A hinge pin is formed outside a left plate of the movable curing edge. Another pair of holes are respectively formed at the upper and bottom portions of a right plate of the movable cutting edge and a right side hinge pin is assembled between the hole of the right plate of the stationary cutting edge and the bottom portion of the right plate of the movable cutting edge. A fixed pin is assembled to the upper portion of the right plate of the movable cutting edge, and the right side hinge pin and the fixed pin are assembled to an outer plate. A shaft of a rotating gear linked with a spindle gear of a motor is inserted to a mortise installed at the bottom portion of the plate. When the spindle gear rotates clockwise by the rotation of the motor, the rotating gear engaged with the spindle gear rotates clockwise. Then, the plate rotates downwardly and the movable cutting edge rotates downwardly about left side hinge pin and the right side hinge pin. Consequently, the thermal paper situated between the stationary cutting edge and movable cutting edge is cut.

Matsumoto (U.S. Pat. No. 5,223,940) uses an image recording apparatus with control of cutter blades and retraction of a recording medium web in response to detection of a cut sheet. This apparatus utilizes two motors to convey a document through the image recording apparatus, cut the document and reverse the direction of the document to allow the movable cutting edge of the automatic cutting device to return to its original position. Additionally, the stationary cutting edge of the automatic cutting device is positioned vertically in relation to the document being conveyed through the image recording apparatus.

SUMMARY OF THE INVENTION

It is therefore an object of the present invention to provide an improved process and apparatus for conveying and cutting paper in a facsimile apparatus.

It is another object to provide a device for conveying paper and moving a movable cutting blade of an automatic cutter with one stepping motor.

It is yet another object to provide an automatic cutting device exhibiting a reduced incidence of paper jamming.

It is still another object to provide an automatic cutting device characterized by a simplified construction and reduced manufactured at a low cost.

These and other objects may be achieved in accordance with one aspect of the present invention, with a device for conveying and automatically cutting paper of a facsimile apparatus using one stepping motor. When the motor rotates in a forward direction, a roller for conveying paper rotates, and when the motor rotates in a reverse direction, the paper is cut. A stationary cutting edge of an automatic cutter is horizontally fixed and a movable cutting edge of a blade installed at the upper portion of the stationary cutting edge moves vertically up and down.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicates the same or similar components, wherein.

DETAILED DESCRIPTION OF THE PREFERRED EMBODIMENT

Figure 1:
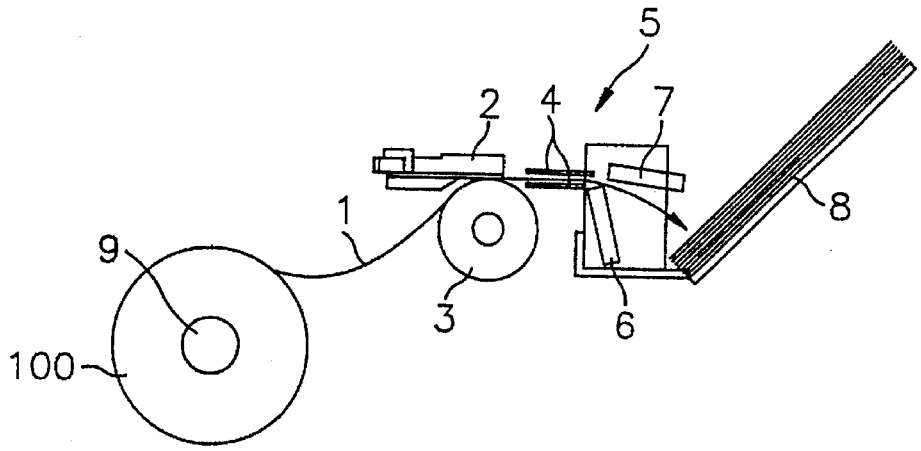
FIG. 1 is a schematic diagram providing and abstract representation of a contemporary facsimile apparatus.

Turning now to the drawings, FIG. 1 shows an abstract, a general composite representation of conventional facsimile apparatus. While a roll of paper 10 on axle roller 9 passes over a roller 3, the contents of a document transmitted from an external source and received by the facsimile apparatus are recorded on a length of the paper 1 drawn from roll 100 by a thermal recording head 2 installed over the roller 3. The paper 1 is conveyed by the rotation of the roller 3 to a guide 4. While the paper 1 passes between a stationary cutting edge 6 and a movable cutting edge 7 that together form an automatic cutter 5, the length of paper 1 is uniformly cut and sequentially stacked in a tray 8.

Figure 2:
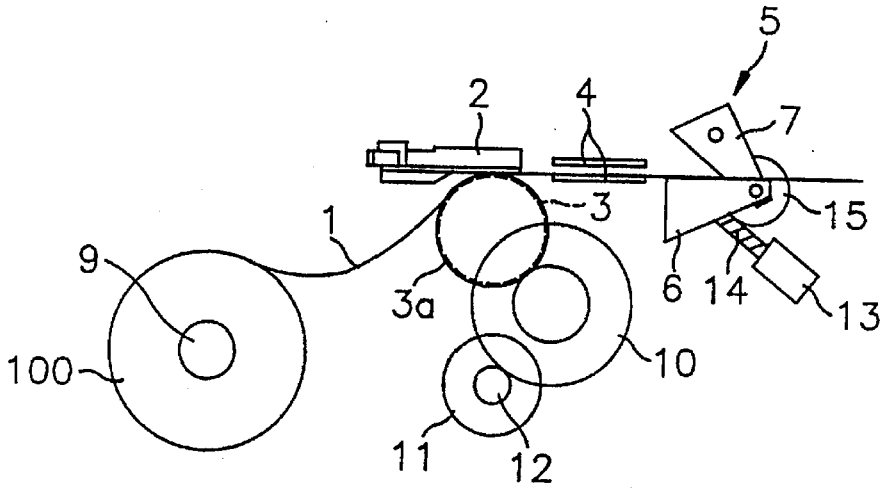
FIG. 2 is an abstract representation of a conventional design for a paper conveying and automatic cutting device.

FIG. 2 shows a conventional paper conveying and automatic cutting device. In order to turn roller 3 installed under thermal recording head 2, gear 3*a* is fixedly mounted at one side of roller 3 and an idle gear 10 is installed to engage gear 3*a* while driving gear 12 of driving motor 11 engages idler gear 10. If driving gear 12 of driving motor 11 rotates clockwise, idler gear 10 rotates counterclockwise, and gear 3*a* rotates clockwise. Accordingly, roller 3 rotates clockwise and the: length of thermal paper 1 on which the contents of a document are recorded by the thermal recording head 2, is conveyed towards the automatic cutter 5.

Figure 3:
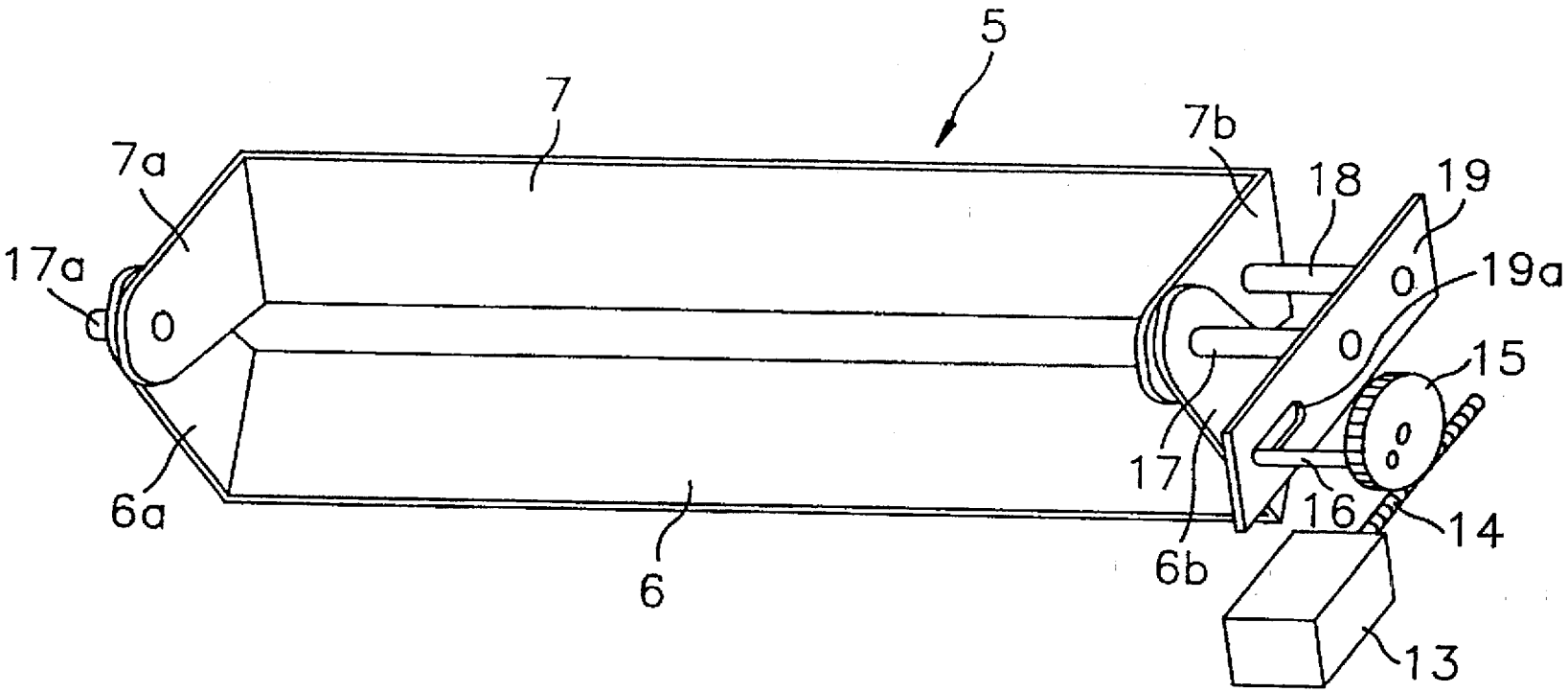
FIG. 3 is an abstract representation of a conventional automatic cutter driving device.

Referring now to FIG. 3, a conventional automatic cutter driving device for cutting a length of thermal paper 1 while the length of thermal paper 1 passes between the stationary cutting edge 6 and movable cutting edge 7 is shown. A hole is respectively formed at left and right plates 6*a* and 6*b* of stationary cutting edge 6 so as to assemble movable cutting edge 7 at the: upper portion of vertically fixed stationary cutting edge 6. A hinge pin 17*a* is formed outside a left plate 7*a* of movable cutting edge 7. A hole is respectively formed at the upper and bottom portions of a right plate 7*b* of movable cutting edge 7 and a right side hinge pin 17 is assembled between the hole of the right plate 6*b* of the stationary cutting edge 6 and that of the bottom portion of right plate 7*b* of movable cutting edge 7. A fixed pin 18 is inserted through the upper portion of right plate 7*b* of movable cutting edge 7, and right side hinge pin 17 and fixed pin 18 are inserted into an outer plate 19. A shaft 16 of a rotating gear 15 linked with a spindle gear 14 of a motor 13 is inserted to a mortised slot 19*a* perforating the bottom portion of plate 19. When spindle gear 14 rotates clockwise by the rotation of motor 13, rotating gear 15 engaged with spindle gear 14 rotates clockwise. Then, plate 19 rotates downward and movable cutting edge 7 rotates downward about left side hinge pin 17*a* and right side hinge pin 17. Consequently, the length of thermal paper 1 situated between stationary cutting edge 6 and movable cutting edge 7 is cut from roll 100.

Motor 13 continues to rotate clockwise after cutting the length of thermal paper 1 and shaft 16 eccentrically mounted to extend axially outwardly from one side of rotating gear 15 that is, in turn, meshed with spindle gear 14, shifts plate 19 downward within mortise 19*a* by sliding shaft 16 within mortise 19*a*. Then the side of right plate 7*b* attached by fixed pin 18 to outter plate 19, moves upwardly and concurrently moves movable cutting edge 7 upwardly from stationary cutting edge 6, thereby conveying the previously cut length of thermal paper 1.

Figure 4:
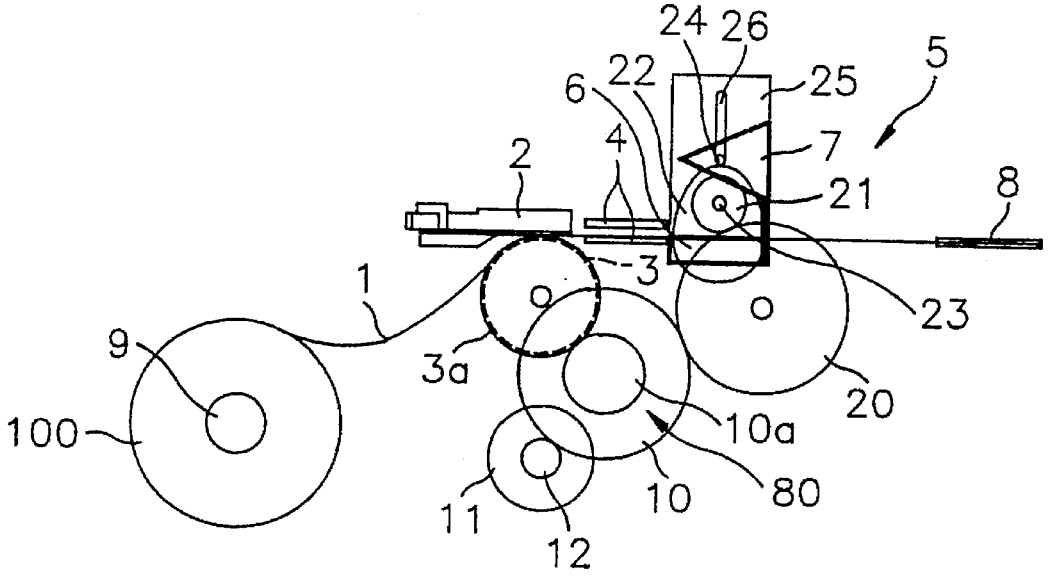
FIG. 4 shows a paper conveying and automatic cutting device constructed according to the principles of the present invention to provide one embodiment of the present invention.
Figure 5A:
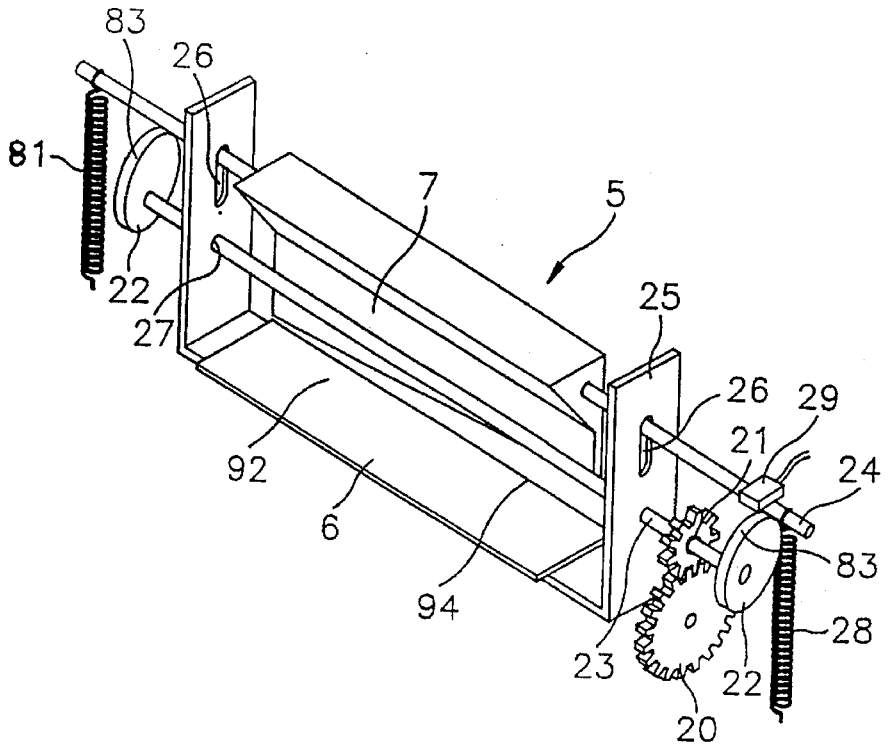
FIGS. 5A and 5B show different operational views of an automatic cutter driving device constructed according to the principles of the present invention.
Figure 5B:
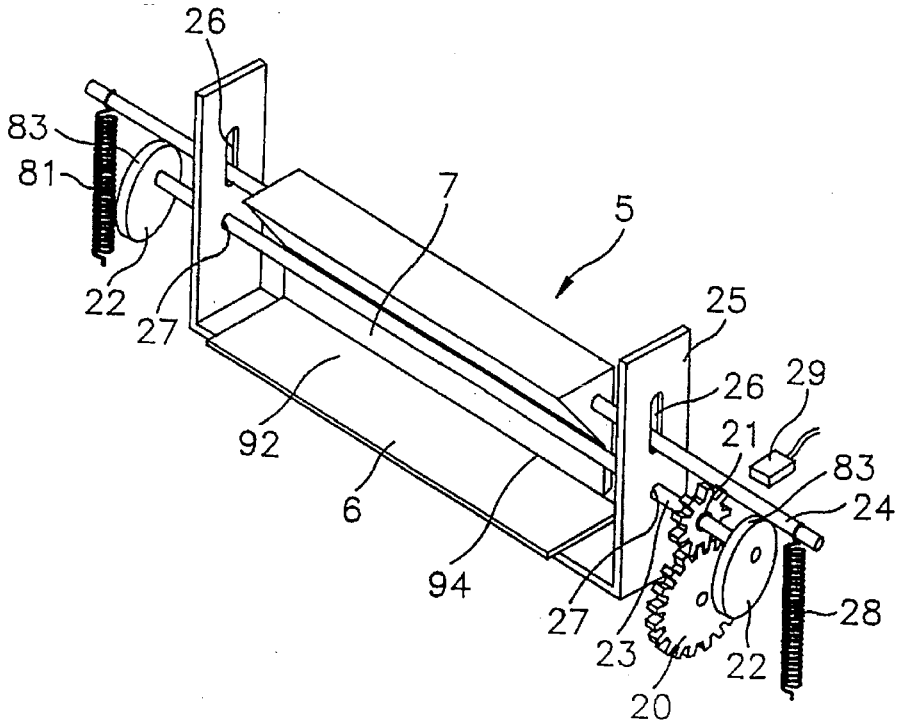

Referring now to FIGS. 4, 5A and 5B, a driving gear 12 has teeth meshing engaged with corresponding teeth of a larger gear 10 of a double gear 80. A small gear 10*a* is meshed with a conveyor gear 3*a* having a one-way clutch installed at one side of a conveyor roller 3 for conveying a thermal paper 1. The larger gear 10 of the double gear 80 is linked with an idler gear 20 and idler gear 20 is engaged with a clutch gear 21 having a one-way clutch installed at a cam shaft 23 of an automatic cutter 5.

In order to install the automatic cutter 5, a mortise 26 is vertically formed at the upper portion of a frame 25 which is crooked at both sides and a shaft hole 27 is formed at the middle portion of the crooked portion of frame 25. A stationary cutting edge 6 with a top side 92 is horizontally fixed at the inner bottom of frame 25. The cam shaft 23 is inserted to shaft hole 27 of frame 25 and clutch gear 21 is installed at cam shaft 23 which is capable of rotating. A cam 22 is fixedly installed at both ends of cam shaft 23. A movable cutting edge 7 is fixed to the middle portion of a shaft 24 inserted into mortise 26 of frame 25 so as to move reciprocally up and down. Tension springs 28 and 81 are downward linked to both ends of shaft 24 so that the shaft 24 is biased downwardly to be held in contact with the exterior circumferential camming surface 83 of cam 22. The bottom portion of the movable cutting edge 7 of a triangular shape centering around the shaft 24 is downward extended, to form a cutting edge, and when the shaft 24 under the bias force of springs 28, 81 sides the cramming surface of 83 of cam 22 downwardly along mortise 26 of frame 25, movable cutting edge 7 moves downwardly. Then, movable cutting edge 7 comes in contact with edge 94 of stationary cutting edge 6 and the length of paper 1 is cut.

If driving gear 12 rotates clockwise under the force of forward rotation of a stepping motor 11, double gear 80 rotates counterclockwise. The teeth of conveyor gear 3*a* are meshed and engaged with the teeth of small gear 10*a* rotates clockwise and the conveyor roller 3 rotates clockwise. Thus, conveyor roller 3 conveys the thermal paper 1 rolled on the roll 100 of the roll 100 of thermal paper 9 toward automatic cutter 5. While the length of thermal paper 1 passes over conveyor roller 3, thermal recording head 2 records the received contents of a document on the length of paper 1. In this case, because the teeth of idler gear 20 are engaged with the teeth of larger gear 10 of the double gear 80 rotates clockwise and turns clutch gear 21 installed on cam shaft 23 of automatic cutter 5. A torque is not transmitted by the clutch gear 21, however, a one-way clutch, to cam shaft 23; consequently clutch gear 21 idles. In such a state, since cam surface 83 of cam 22 positioned at the apogee or longest distance from the center of cam shaft 23 touches shaft 24 on which movable cutting edge 7 is installed, and stationary cutting edge 6 fixed at the inner bottom of the frame 25 is separated from movable cutting edge 7. Hence, the paper 1 is conveyed by conveyor roller 3 and guided between spaced-apart guides 4. Then, the paper 1 is conveyed between stationary cutting edge 6 and movable cutting edge 7.

In order to uniformly cut the length of thermal paper 1 from roll 100 while the length of paper 1 is passing between stationary cutting edge 6 and movable cutting edge 7, stepping motor 11 rotates reversely and driving gear 12 rotates counterclockwise. Then double gear 80 rotates clockwise and idler gear 20 engaged with larger gear 10 rotates counterclockwise. Clutch gear 21 of cam shaft 23 rotates clockwise and exerts a torque onto cam shaft 23 to turn cam shaft 23 clockwise. As a result, cams 22 mounted at axially opposite left and right ends of shaft 23 rotate together, and shaft 24 moves downward under the force of tension springs 28 and 81 to ride along curved cam surface 83 of the cam 22. Then, movable cutting edge 7 comes in contact with the end of the stationary cutting edge 6 horizontally fixed at the inner bottom of frame 25, and the length of thermal paper 1 between movable cutting edge 7 and stationary cutting edge 6 is cut. When cam surface 83 located at the perigee or shortest distance from the center of the cam, shaft 23 is in contact with the shaft 24 by the rotation of the cam 22, the length of paper 1 is cut and cam 22 continues to rotate. As cam 22 continues to rotate, cam surface 83 pushes shaft 24 and movable cutting edge 7 is held upwardly until cam surface 83 positioned at the apogee from the center of cam shaft 23 is in contact with shaft 24. A microswitch 29 located above shaft 24 is touched by shaft 24 and stops the rotation of stepping motor 11 by interrupting electrical current to motor 11 when shaft 24 reaches the portion of cam surface 83 positioned at the greatest distance from the center of cam shaft 23. Thus, the automatic cutter 5 is returned to its initial position.

In order to convey additional lengths of thermal paper 1, stepping motor 11 rotates forwardly and convey roller 3 rotates clockwise when driven by driving gear 12 and double gear 80. Then, another length of thermal paper 1 is conveyed toward automatic cutter 5 by conveyor roller 3. Moreover, through the reverse rotation of the stepping motor 11, the length of paper 1 is cut from roller 100.

Figure 6A:
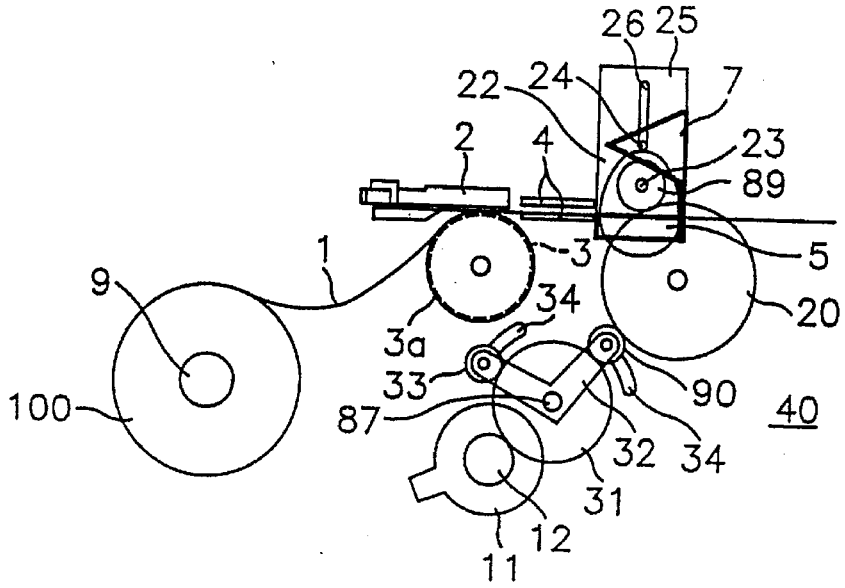
FIGS. 6A and 6B show different operational views of a paper conveying and automatic cutting device constructed according to the principles of the present invention to provide another embodiment of the present invention.
Figure 6B:
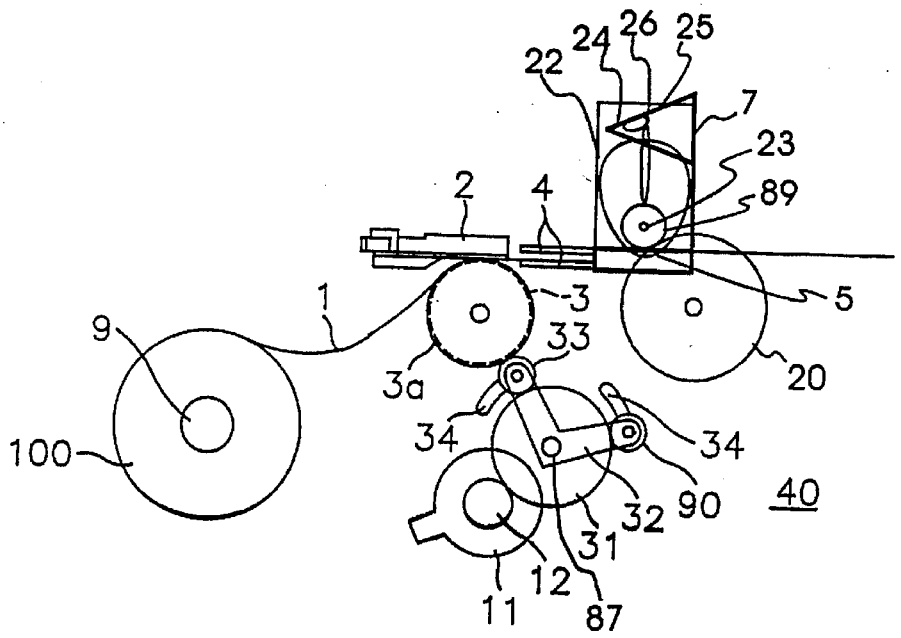

FIGS. 6A and 6B show a paper conveying and automatic cutting device constructed according to the another embodiment of the present invention. A bell crank or V-type link 32 is installed at shaft 87 of a power transfer gear 31 engaged with the driving gear 12 of the stepping motor 11 so as to rotate. A left coupling gear 33 and and right coupling gear 90 are disposed at the both ends of the bell crank 32 and move along a rail 34 formed at a body plate 40, and selectively engage conveyor gear 3*a* and idler gear 20. Idler gear 20, respectively is engaged with fixed gear 89 coaxially mounted on cam shaft 23 of automatic cutter 5. The construction of the automatic cutter driving device may be the same as that shown by FIG. 5, except that clutch gear 21 is replaced with fixed gear 89;

FIG. 6B depicts the paper conveying and automatic cutting device positioned to convey a length of thermal paper 1. If stepping motor 11 rotates in the reverse direction, driving gear 12 rotates counterclockwise and power transfer gear 31 rotates clockwise. Left coupling gear 33 installed on bell crank 32 rotates counterclockwise, causing link 32 to rotate clockwise with power transfer gear 31. Left coupling gear 33 moves along rail 34 until left coupling gear 33 engages conveyor gear 3*a* turning conveyor roller 3. Then, conveyor gear 3*a* rotates clockwise and the length of paper 1 is conveyed toward automatic cutter 5. Right coupling gear 90 is disengaged from idler gear 20, causing driving automatic cutter 5 to idle. While the length of paper 1 passes over conveyor roller 3, thermal recording head 2 records received information in the form of images in order to create a document on the length of thermal paper 1. Under such a state, since the cam surface 83 of the cam 22 located at the longest distance from the center of cam shaft 23 is in contact with the shaft 24, stationary cutting edge 6 fixed at the inner bottom of frame 25 is separated from the movable cutting edge 7. Then, the length of thermal paper 1 is conveyed by conveyor roller 3 and guided between the guides 4. Thus, the length of thermal paper 1 is conveyed between stationary cutting edge 6 and movable cutting edge 7.

FIG. 6A depicts the paper conveying and automatic cutting device positioned to cut the length of thermal paper 1. In order to uniformly cut the length of thermal paper 1 from roll 100 while thermal paper 1 passes between stationary cutting edge 6 and movable cutting edge 7, driving gear 12 rotates clockwise in response to a forward rotation of stepping motor 11 and power transfer gear 31 rotates counterclockwise. Then right coupling gear 90 rotates clockwise. Bell crank 32 rotates counterclockwise and right coupling gear 90 by rail 34 of body plate 40. Right coupling gear 90 engages idler gear 20 and turns idler gear 20 counterclockwise. Fixed gear 89 fixedly attached to cam shaft 23 of automatic cutter 5 rotates clockwise and turns cam shaft 23 to simultaneously rotate left and right cams 22. Shaft 24 moves downward under the downward force produced by tension springs 28 and 81 along cawed cam surfaces 83 of cams 22, and movable cutting edge 7 contacts the end of the stationary cutting edge 6 horizontally fixed at the inner bottom of the frame 25. Consequently, thermal paper 1 situated between movable cutting edge 7 and stationary cutting edge 6 is cut. When cam surfaces 83 of cams 22 are located at the least distance from the center of cam shaft, the length of paper 1 is cut from roll 100 as cams 22 continue to rotate. Then, cam surfaces 83 push shaft 24 upward until movable cutting edge 7 is fixed, as cam surfaces 83 are positioned at the longest distance from the center of cam shaft 23. A microswitch 29 located above shaft 24 makes contact with shaft 24 to stop the rotation of stepping motor 11. Thus, the automatic cutter 5 is returned to its initial position.

In order to again convey the length of thermal paper 1, stepping motor 11 rotates in the reverse direction and conveyor gear 3*a* rotates clockwise in response to left coupling gear 33, driving gear 12 and power transfer gear 31. Then, the length of thermal paper 1 is conveyed toward automatic cutter 5. When the stepping motor 11 rotates in the forward direction, idler gear 20 rotates counterclockwise in response to the right coupling gear 90, the driving gear 12 and power transfer gear 31. Gear 21 of cam shaft 23 rotates clockwise and movable cutting edge 7 reciprocates up and down. Thus the length of paper 1 is cut from roll of paper 100.

As described above, a roller for conveying the paper and the movable cutting edge of the automatic cutter can be shifted by one stepping motor, and occurrence of paper jams can be prevented since the stationary cutting edge is horizontally fixed. Furthermore, the automatic cutter can be simply constructed at relatively low manufacturing cost.

While preferred embodiments of the invention have been particularly shown and described, it will be understood by those skilled in the art that foregoing and other changes in form and details may be made without departing from the spirit and scope of the present invention.

What is claimed is:

1. A device for conveying and automatically cutting paper of a facsimile apparatus, comprising:

a single source of rotational energy;

a double gear having a large gear coaxially rotating together with a small gear, said double gear being bidirectionally rotatable by said single source of rotational energy;

a first one-way clutch transmitting said rotational energy while said source rotates in a first rotary direction;

a second one-way clutch transmitting said rotational energy while said source rotates in a second and opposite rotary direction;

a conveyor roller for conveying paper along a first linear path through the apparatus, said conveyor roller having a conveyor gear, said conveyor roller being attached to said conveyor gear via said first one-way clutch;

a cam shaft;

a clutch gear connected via said second one-way clutch to said cam shaft;

said small gear being meshed with said conveyor gear;

an idler gear engaged with said large gear and said clutch gear;

a pair of eccentric cams mounted on opposite ends of said cam shaft to rotate with said opposite ends of said cam shaft;

a second shaft having two end portions and a middle portion;

a pair of springs installed at different ends of said second shaft to hold said two end portions in contact responsive to rotation of corresponding ones of said cams; and a movable cutting blade attached to said middle portion of said second shaft, said end portions of said second shaft driving said movable cutting unit to reciprocate along a second linear path orthogonal to said first linear path.

2. The apparatus of claim 1, where said conveyor roller is stationary and does not convey paper while said movable cutting blade is oscillating along said second linear path.

3. A device for automatically cutting paper of a facsimile apparatus, comprising:

a single source of rotational energy;

an input gear being bidirectionally rotatable by said single source of energy;

a conveyor gear rotatably engaged to be rotatably driven bidirectionally by said input gear;

a first one-way clutch transmitting said rotational energy while said source rotates in a first rotary direction;

a conveyor roller attached to said conveyor gear via said first one-way clutch, said roller being positioned to convey paper along a path within said apparatus;

a U-shaped frame having a pair of slots, each of said pair of slots vertically formed at the upper portion of respective opposite sides of said frame, said frame being crooked at said opposite sides and having a pair of shaft holes, each of said pair of shaft holes formed at the middle portion of each of said respective opposite sides;

a stationary cutting unit horizontally formed on a bottom portion of said frame between said opposite sides, transmitting said rotational energy while said source rotates in a second and opposite rotary direction;

a clutch gear having a second one way clutch installed on a cam shaft, said cam shaft being inserted through each of said pair of shaft holes of said frame, said cam shaft being capable of rotating;

a pair of cams, each fixedly installed at each respective end of said cam shaft;

a movable cutting unit fixed to the middle portion of a second shaft, said second shaft being inserted into said pair of slots on said frame to enable said movable cutting unit to reciprocally move up and down across said path and relative to said stationary cutting unit; and a pair of tension springs, installed between each respective end of said second shaft to respectively hold each end of said second shaft in contact with said cams.

4. The device, as claimed in claim 1, wherein said movable cutting unit has a cutting edge extending downward from a bottom portion of a triangular shaped piece centered about said second shaft.

5. The device as claimed in claim 4, wherein said movable cutting unit moves towards said stationary cutting unit and comes in contact with said stationary cutting unit to cut said paper.

6. The device as claimed in claim 3, wherein each of said pair of cams on said cam shaft is eccentrically positioned on said cam shaft and is always in contact with each respective end of said second shaft, wherein the apogee of each of said pair of cams comes in contact with said second shaft when said paper is being conveyed, and the perigee of each of said pair of cams comes in contact with said second shaft when said paper is being cut.

7. The apparatus of claim 3, where said conveyor roller is stationary and does not convey paper while said movable cutting unit is oscillating across said path and relative to said stationary cutting unit.

8. A device for conveying and automatically cutting paper of a facsimile apparatus, comprising:

a first shaft of a power transfer gear;

a driving gear of a motor;

a bell crank installed to rotate about said first shaft of the power transfer gear engaged with said driving gear;

a conveyor gear;

a conveyor roller fixedly connected to rotate with said conveyor gear and convey paper along a path within said apparatus;

an idler gear;

a third gear rotatably engaged with said idler gear;

a cam shaft rotatably driven by said third gear;

an automatic cutter mounted on said cam shaft in a position to respond to movement of said third gear relative to said cam shaft by reciprocating transversely across said path;

a plate bearing a pair of curved slots formed in said plate; and a pair of coupling gears installed at opposite ends of said bell crank, each of said pair of coupling gears moving along different ones of said pair of curved slots formed in said body plate and being selectively engaged in dependence upon the direction of rotation of said driving gear to drivingly rotate alternate ones of said conveyor gear and said idler gear.

9. The device for conveying and automatically cutting paper of a facsimile apparatus of claim 8, said automatic cutter further comprises:

a U-shaped frame having a pair of vertical slots, each one of said pair of vertical slots formed at the upper portion of respective opposite sides of said frame, said frame being crooked at said opposite sides and having shaft holes formed at middle portions of each of said sides;

a stationary cutting unit horizontally formed on a bottom portion of said frame between said opposite sides;

said cam shaft having a first end and a second end, said first end and said second end of said cam shaft being rotatably received within corresponding ones of said holes formed at said middle portions of each of said sides of said U-shaped frame;

a pair of eccentric cams, each one of said pair of eccentric cams being fixedly installed at said first end and said second end respectively of said cam shaft;

a movable cutting unit fixed to the middle portion of a second shaft, said second shaft inserted into said pair of vertical slots on said frame so as to enable said movable cutting unit to move up and down transversely across said path; and a pair of tension springs, each installed at each respective end of said second shaft to respectively hold each of said eccentric cams into contact with said second shaft.

10. The apparatus of claim 9, where said conveyor roller is stationary and does not convey paper while said movable cutting unit is oscillating transversely across said path.

11. A device for conveying and automatically cutting paper of a facsimile apparatus, comprising:

a U-shaped frame having a pair of vertical slots, each one of said pair of vertical slots formed at an upper portion of different ones of opposite sides of said frame, said frame being crooked at said opposite sides and having a shaft hole formed at the middle portion of each of said sides;

a stationary cutting unit horizontally formed on a bottom portion of said frame between said opposite sides;

a cam shaft;

a second shaft;

a first shaft of a power transfer gear;

a third gear fixed on said cam shaft, said cam shaft being inserted into each said shaft hole of said frame, said cam shaft being capable of rotating;

a pair of eccentric calm, each fixedly installed at opposite ends of said cam shaft;

a movable cutting unit fixed to the middle portion of said second shaft, said second shaft inserted into said pair of vertical slots on said frame so as to enable said movable cutting unit to move up and down in a first reciprocal direction relative to said stationary cutting unit;

a pair of tension springs, each installed at respective ends of said second shaft to respectively hold each end of said second shaft in contact with respective ones of said pair of cams;

a bidirectionally rotatable driving gear of a motor engaged to said power transfer gear;

a bell crank installed to rotate about said first shaft of said power transfer gear;

a conveyor gear;

an idler gear being engaged with said third gear;

a conveyor roller fixedly connected to said conveyor gear;

a plate;

a pair of curved slots formed in said plate; and a pair of coupling gears, each installed at the both ends of said bell crank, each of said pair of coupling gears moving along respective ones of said pair of curved slots formed in said plate and being selectively engaged, dependent upon the direction of said driving gear, to alternately drive said conveyor gear and said idler gear.

12. An apparatus for conveying a sheet of paper through a facsimile device and cutting said paper, comprising:

a motor operable in a forward and a reverse direction;

a printing means for priming an image onto said sheet of paper;

a conveyor roller positioned under said printing means for conveying said sheet of paper to said printing means;

a conveyor gear installed at one side of said conveyor roller and powered by said motor, said conveyor gear having a first one-way clutch such that said conveyor gear turns said conveyor roller when said motor operates in said forward direction and said conveyor gear allows said conveyor roller to remain stationary when said motor operates in said reverse direction;

a second one-way clutch transmitting rotational energy while said motor rotates in said reverse direction;

cutting means having a stationary cutting edge and a movable cutting edge for cutting said sheet of paper, said stationary cutting edge comprised of a plate having a top side and a cutting edge, said top side of said plate positioned in parallel with said printing means such that said top side of said plate slidingly receives said sheet of paper after said image has been printed onto said sheet of paper, said movable cutting edge powered by said motor via said second one-way clutch as said motor operates in said reverse direction, said movable cutting edge comprised of a plate positioned perpendicular to and above said top side of said stationary cutting edge such that said moveable cutting edge moves from a first position away from said stationary cutting edge and slides toward said stationary cutting edge to a second position to cut said sheet of paper; and a receiving means positioned to receive and retain said sheet of paper after said cutting means has cut said sheet of paper.

13. An apparatus for conveying a sheet of paper through a facsimile device and curing said paper as claimed in claim 12, further comprising:

a first shaft having a first axis extending through distal ends of said first shaft, said first shaft being attached to said movable cutting edge with said first axis being parallel to said movable cutting edge;

a frame fixably attached to said stationary cutting edge, said frame having a slot for slidingly engaging said first shaft;

a cam shaft having a second axis extending through distal ends of said cam shaft, wherein said cam shaft rotates upon said second axis and is fixedly positioned onto said frame between said first shaft and said stationary cutting edge;

a pair of eccentric cams for moving said movable cutting edge from said first position to said second position, each one of said pair of cams having a periphery and a cam surface around said periphery, each one of said pair of cams being fixedly attached to respective ends of said cam shaft with said cam surfaces continually contacting said first shaft and causing a distance between said cam shaft and said first shaft to oscillate as said movable cutting edge oscillates between said first position and said second position while said cam shaft rotates;

a clutch gear installed on said cam shaft and powered by said motor, said clutch gear having a second one-way clutch such that said clutch gear rotates said cam shaft upon said rotating axis when said motor operates in said reverse direction and said clutch gear allows said cam shaft to remain stationary when said motor operates in said forward direction; and a sensing means for determining when said movable cutting edge has reached said first position and ceasing operation of said motor in said reverse direction when said movable cutting edge has reached said first position.

14. An apparatus for conveying a sheet of paper through a facsimile device and cutting said paper as claimed in claim 13, wherein said motor further comprises:

a second shaft extending from said motor, said second shaft rotating in said forward and said reverse directions;

a driving gear attached to said second shaft of said motor;

a double gear having a large gear meshing with said driving gear of said motor and having a small gear fixably attached to said large gear, said small gear meshing with said conveyor gear; and an idler gear meshing with both said large gear of said double gear and said clutch gear.

15. The apparatus of claim 13, where said conveyor roller is stationary and does not convey paper while said movable cutting edge is oscillating between said first position and said second position.

16. A device for conveying and automatically cutting paper of a facsimile apparatus, comprising:

a stationary cutting edge;

a frame;

a motor providing rotation in both a forward direction and a reverse direction;

a driving gear rotatably driven in both of said two directions by said motor;

a doubling gear engaged to be rotated in both directions by said driving gear;

a conveyor gear rotatably engaged to be rotatably driven in both of said directions by said doubling gear, said conveyor gear containing a first clutch;

a conveyor roller attached to said conveyor gear via said first clutch, said conveyor roller rotates and conveys paper over said stationary cutting edge only when said motor is operated in said forward direction;

an idler gear rotatably engaged to be rotatably driven in both of said directions by said doubling gear;

a clutch gear rotatably engaged to be rotatably driven in both of said directions by said idler gear, said clutch gear containing a second clutch;

a cam shaft positioned on said frame, said cam shaft attached to said clutch gear via said second clutch; said cam shaft rotates only when said motor is operated in said reverse direction;

a pair of cams, each eccentrically positioned on opposite ends of said cam shaft;

a second shaft positioned on said frame parallel to and above said cam shaft, opposite ends of said second shaft resting on and in contact with corresponding ones of said pair of cams, said second shaft oscillating in a first reciprocal direction between a high position and a low position in response to the camming action of said pair of cams rotating on said cam shaft; and a movable cutting edge positioned on said second shaft, said movable cutting edge oscillating in said first reciprocal direction with said second shaft, cutting paper resting on said stationary cutting edge when said second shaft reaches said low position.

17. The apparatus of claim 16, further comprising a microsensor that resumes motor operation in said forward direction in response to sensing said second shaft returning to said high position.

18. The apparatus of claim 17, where said frame is crooked.

19. The apparatus of claim 17, where said conveyor roller is stationary and does not convey paper while said movable cutting edge is oscillating in said first reciprocal direction.

20. A device for conveying and automatically cutting paper of a facsimile apparatus, comprising:

a stationary cutting edge;

a frame;

a motor providing rotation in both a forward direction and a reverse direction;

a driving gear rotatably driven in both of said two directions by said motor;

a power transfer gear engaged to be rotated about a third shaft and in both directions by said driving gear;

a bell crank rotatably driven in both of said two directions by said power transfer gear;

a first and a second coupling gear, each rotatably installed at each end of said bell crank and each moves along a rail formed in a body plate, said first coupling gear is rotatably engaged to and rotatably drives said conveyor gear when said motor is operated in said reverse direction, and said second coupling gear is rotatably engaged to and rotatably drives said idler gear when said motor is operated in said forward direction;

a conveyor roller fixedly attached to and driven by said conveyor gear, said conveyor roller rotates and conveys paper over said stationary cutting edge;

a third gear rotatably engaged to be rotatably driven by said idler gear;

a cam shaft positioned on said frame, said cam shaft engaged to be rotatably driven by said third gear fixedly attached to said cam shaft;

a pair of cams, each eccentrically positioned on opposite ends of said cam shaft;

a second shall positioned on said frame parallel to and above said cam shaft, opposite ends of said second shalt resting on and in contact with corresponding ones of said pair of cams, said second shalt oscillating in a first reciprocal direction between a high position and a low position in response to the camming action of said pair of cams rotating on said cam shaft; and a movable cutting edge positioned on said second shaft, said movable cutting edge oscillating in said first reciprocal direction with said second shalt, cutting paper resting on said stationary cutting edge when said second shaft reaches said low position.

21. The apparatus of claim 20, further comprising a microsensor that resumes motor operation in said forward direction in response to sensing said second shaft returning to said high position.

22. The apparatus of claim 21, where said frame is crooked.

23. The apparatus of claim 20, where said conveyor roller is stationary and does not convey paper while said movable cutting edge is oscillating in said first reciprocal direction.

* * * * *